United States Patent [19]

Kennedy

[11] Patent Number: 4,797,025

[45] Date of Patent: Jan. 10, 1989

[54] DEVICE FOR CUTTING A RECEPTACLE IN PAVEMENT TO RECEIVE A REFLECTOR

[75] Inventors: Ralph Kennedy, Pataskala, Ohio

[73] Assignee: Ampsco Corporation, Columbus, Ohio

[21] Appl. No.: 168,086

[22] Filed: Mar. 14, 1988

[51] Int. Cl.[4] ..... E01C 23/09

[52] U.S. Cl. ..... 404/90; 404/93; 299/38; 299/39; 51/101 R; 125/14

[58] Field of Search ..... 404/87, 89, 90, 91, 404/93, 94; 299/36–40; 83/928; 144/142; 51/101 R, 176, 283 R; 125/14

[56] References Cited

U.S. PATENT DOCUMENTS

| | | | |
|---|---|---|---|
| 3,007,687 | 11/1961 | Hatcher | 51/176 X |
| 3,724,900 | 4/1973 | Hatcher et al. | 51/176 X |
| 3,740,099 | 6/1973 | Lenzner | 299/39 |
| 3,957,095 | 5/1976 | Johnson | 144/142 X |
| 4,174,184 | 11/1979 | Heenan | 404/94 X |
| 4,247,148 | 1/1981 | Eriksson | 299/40 |
| 4,463,989 | 8/1984 | Kennedy | 299/39 |

*Primary Examiner*—Jerome W. Massie, IV
*Assistant Examiner*—John F. Letchford
*Attorney, Agent, or Firm*—John L. Gray

[57] ABSTRACT

A device for cutting slots of varying lengths and shapes in pavement to receive a reflector, the cutting blades for cutting the slot always being at right angles to the tangent to that portion of the surface of the pavement where the slot is being cut and means permitting the cutting blades to be maintained at an optimal rotational speed regardless of the density of the type of pavement encountered.

6 Claims, 5 Drawing Sheets

DEVICE FOR CUTTING A RECEPTACLE IN PAVEMENT TO RECEIVE A REFLECTOR

BACKGROUND OF THE INVENTION

It is standard practice to provide roadways with reflective markers embedded in the roadways to designate the separation between traffic lanes. It is normal practice to provide an intermittent white paint line between traffic lanes, each paint line being 10 feet long, separated from the next section of paint line by a distance of 30 feet. This unpainted portion is known as the "skip" line. The reflector is positioned exactly in the middle of the skip line, 15 feet from the ends of each 10 foot paint line. On main highways and straightaways the reflector is positioned in alternate skip lines. On curves and on rural roads the reflector is positioned on each skip line. In those portions of the United States that is subject to snowfall and consequent plowing by snowplows to remove the snow, it is necessary to protect the reflector from damage by the edge of the mold board of the snowplow. In the case of raised reflectors, a raised cast iron H-shaped unit in which the reflector is embedded has been developed for this purpose. An example of such a unit is the Stinsonite 96. This type of reflector and means for cutting a receptacle in the pavement to receive it is described in U.S. Pat. No. 4,463,989, Kennedy.

An alternative solution to this problem which is used in some jurisdictions is to provide a slot, usually about 4¾ inches wide, ⅝ inches deep, and 52 inches in length. This slot may be flat with rounded portions at each end for two-way traffic, each end housing a reflector which is attached to the bottom of the slot at each end by means of epoxy adhesive. In the case of one-way traffic, the slot quite frequently is sloping throughout the entire length of the slot down to a maximum depth near the end at which point a reflector is attached to the base by means of epoxy adhesive.

In cutting such slots it is desirable to have the surface speed of the cutting blades at an optimum amount. This speed will vary from 9,000 to 12,000 feet per minute depending upon the diameter of the blade and the pavement being cut. Blades used for this purpose have diamond cutting edges and are very expensive, costing about $1,200. In making a cut 4¾ inches wide, 16 or 17 blades must be ganged together. If the blades are operated at other than an optimum speed, the cutting edge will wear down at a much more rapid rate thus dramatically increasing the cost of operation. The surface speed of the blade and the transverse speed of the platform supporting the blade are manually controlled by the operator so that when varying densities of the material being cut are encountered the judgment of the operator is relied upon to slow the transverse movement of the platform or to modify the speed of the blade, or both, and, of course, the manner in which this is done will vary from operator to operator, depending upon their experience.

Solutions to this wear problem are described in greater detail in co-pending patent application Ser. No. 927,210, Kennedy, entitled Self-Regulating Concrete Cutting Saw.

The present invention relates to a portable, self-propelled machine which may be used to cut a slot in the surface of pavement, the shape and length of said slot being determined by rotating cams which guide the movement of the rotary cutting blades which are used to cut the slot. The cams, which are positioned on a common shaft connected to the shaft on which the rotary cutting blades are mounted, also serves to position the rotary cutting blades so that they always perform their cutting function while at right angles to the tangent to that portion of the surface of the pavement in which the slot is to be cut.

Furthermore, this invention embodies an automatic control mechanism which will reduce the speed of the motor propelling the device so that the rotating cutting blades are always operated at maximum efficiency.

It is therefore an object of this invention to provide a self-propelled device for cutting a slot in the surface of the pavement in which the shape and length of said slot is determined by a plurality of cams attached to the cutting blades.

It is another object of this invention to provide such a device in which the cams also function to insure that the rotary cutting means performs its cutting function while at right angles to the tangent to that portion of the surface of pavement in which the slot is to be cut.

It is still another object of this invention to provide a self-propelled pavement slot cutting machine in which the longitudinal movement of the cutting blades through the pavement will vary, depending upon the density of the pavement encountered with the rotational speed of the blades being maintained essentially constant.

These, together with other objects and advantages of the invention will become more readily apparent to those skilled in the art when the following general statements and descriptions are read in the light of the appended drawings.

DETAILED DESCRIPTION OF THE DRAWINGS

Figure 1:
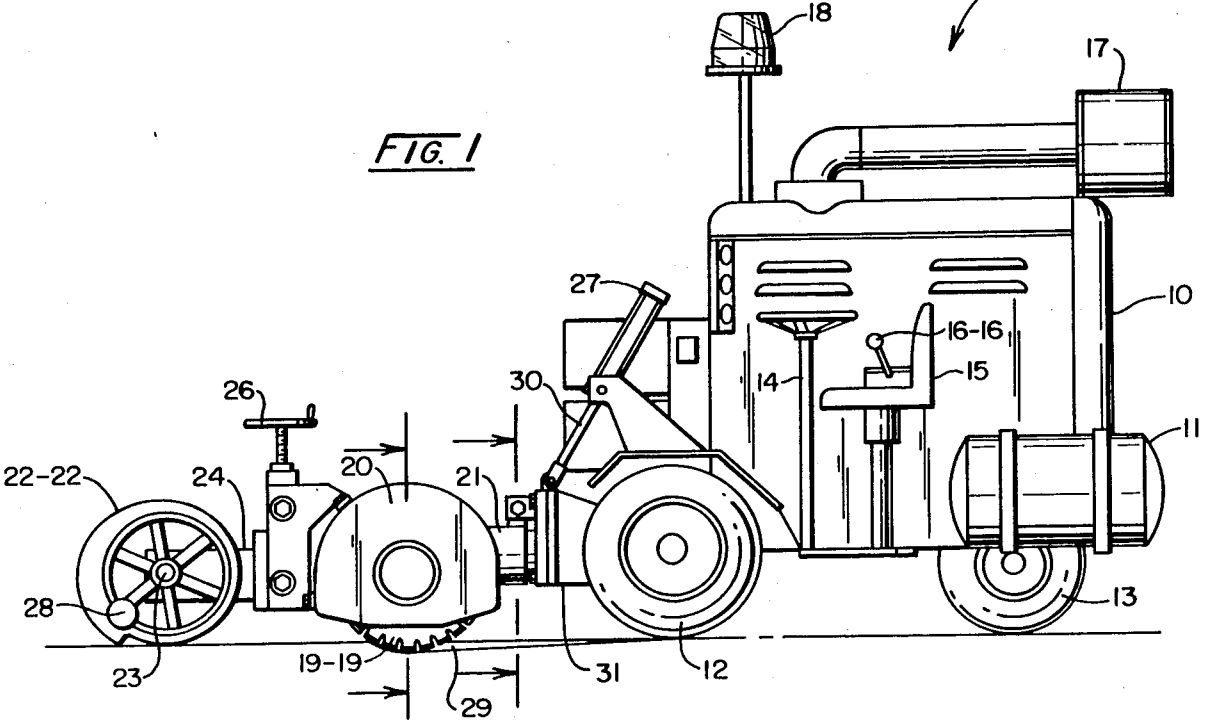
FIG. 1 is a side elevation view of the device for cutting a slot in the surface of the pavement constituting applicant's invention.

Referring now more particularly to FIG. 1, the device incorporating the present invention is shown generally at 9, provided with an engine housing 10, a fuel tank 11, two forward support wheels 12—12, and a rear steering wheel 13 which may be operated by steering wheel 14. A seat 15 is provided for the operator and motor controls 16—16 are also provided. Preferably, the motors controlling the horizontal movement of the device 9 and the cutting blades 16—16 are hydraulic motors operated by hydraulic fluid from pumps driven by a diesel prime mover (not shown) housed in engine housing 10. See FIG. 7 for details of operation of the hydraulic pumps and motors. The exhaust muffler 17 is shown as well as rotating safety beacon 18. The rotating cutting blades 19—19 are enclosed in housing 20 and rotatably supported by member 21.

The water used in connection with the cutting action of cutting blades 19—19 and which may be sprayed on cutting blades 19—19 may be carried by a separate tank truck which follows the device constituting this invention so that the truck can go and replenish its water supply while another truck stands in to furnish water.

Connected to the cutting blades 19—19 are cams 22—22 positioned on a common shaft 23 and connected by means of member 24 to the support shaft 25 of cutting wheels 19—19. (See FIG. 6.) The depth of cut of the blades 19—19 may be adjusted by means of wheel 26 and the assemblage of cams 22—22 and cutting blades 19—19 may be raised or lowered by the operator by means of hydraulic cylinder 27 and piston 30. Cams 22—22 are each provided with a weight 28 which insures that the cams 22—22 are always in the proper position at the start of a cut. The position of the cutting blades 19—19 and the cams 22—22, as shown in FIG. 1, have resulted in cutting the slot 29 as shown. Piston 30 is attached to the frame 31 which is attached to member 21 and pivoted on the frame of the vehicle for vertical movement.

Figure 2:
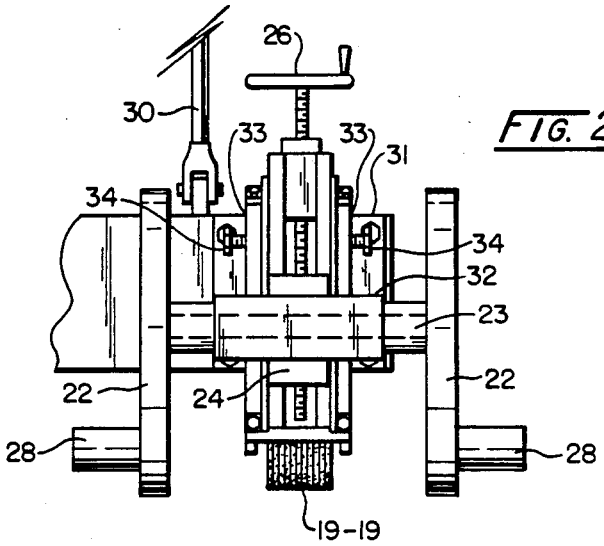
FIG. 2 is a front elevation view of the cutting wheel and cams shown in FIG. 1.

Referring now more particularly to FIG. 2, it will be seen that the shaft 23 on which cams 22—22 are mounted is mounted in a sleeve 32 which is fixedly connected to the member 24 which in turn is rigidly connected to the supports 33—33 supporting the cutting blades 19—19. Thus as the shaft 23 is tilted by the cams 22—22, depending upon the crown of the road being cut, the support shaft 25 of the blades 19—19 is also tilted, since the system is connected together, so that the cutting blades 19—19 are always at right angles to the tangent to that portion of the surface of the pavement in which the slot is being cut. Bolts 34—34 are used to assist in securing the cutting blades 19—19 and cams 22—22 assemblage to the frame of the vehicle.

Figure 3:
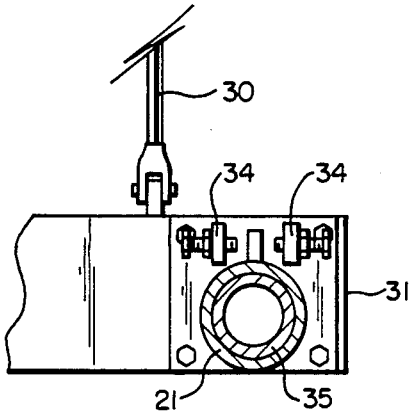
FIG. 3 is a section through FIG. 1 on the plane 3—3.

Referring now more particularly to FIG. 3, it will be seen that member 21 surrounds and is supported by tube 35, permitting member 21 to rotate as necessary to insure that the cutting blades 19—19 are always at right angles to the tangent to that portion of the surface of the pavement in which the slot is being cut.

Figure 4:
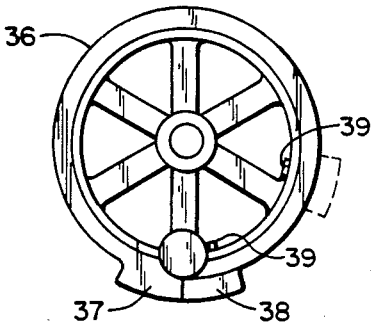
FIG. 4 is a detail of a cam provided with a movable portion which is used to vary the length of the slot being cut.

Referring now more particularly to FIG. 4, there is shown a modified version 36 of the cam 22. The cam 22 is designed to cut a slot in the pavement that tapers down for use in one-way traffic installations. Cam 36, on the other hand, is used to cut a flat bottomed slot with rounded ends which is used for two-way traffic installations. One of the upstanding portions 37 of cam 36 is fixed but the other upstanding portion 38 of cam 36 may be moved to a position shown in dotted outline or any position therebetween by loosening the bolts 39—39 and moving the portion 38 to the desired position and then retightening the bolts 39—39.

Figure 5:
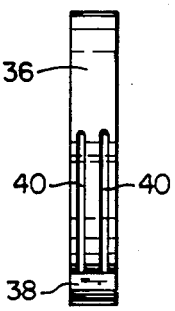
FIG. 5 is a side elevation view of FIG. 4.

FIG. 5 is an end view of the cam shown in FIG. 4 showing the slots 40—40 in which the bolts 39—39 fit to engage the comparable corresponding portion of portion 38.

Figure 6:
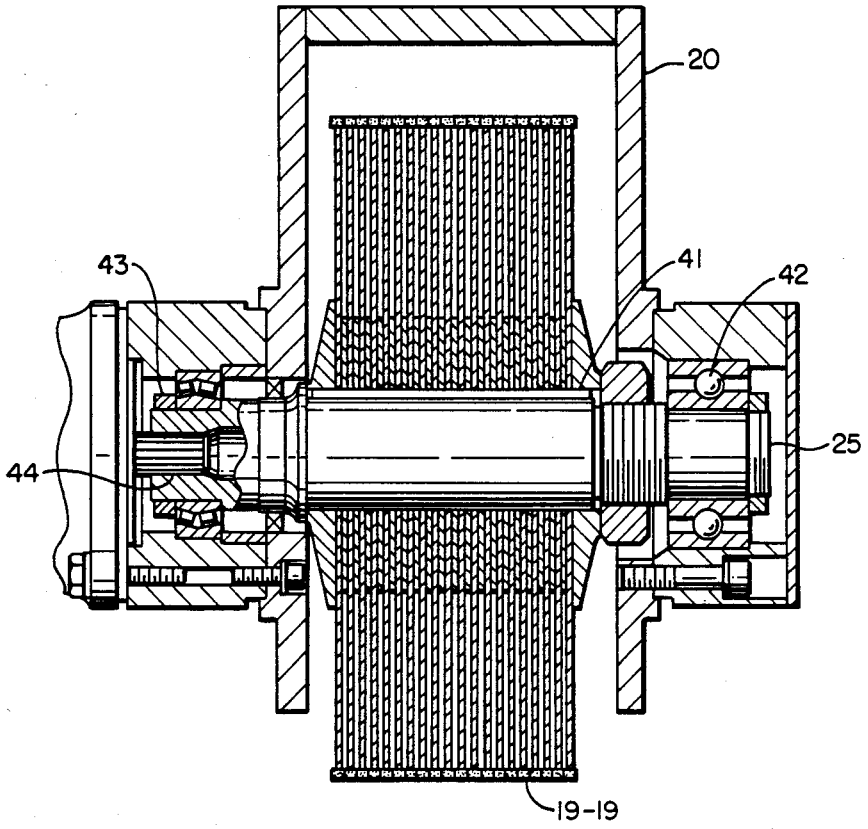
FIG. 6 is a detail of the cutting blades on the plane 6—6 of FIG. 1.

Referring now more particularly to FIG. 6, which is a section of the cutting blades 19—19 on plane 6—6, the cutting blades 19—19 are keyed through a suitable key 41 to the shaft 25 which is in turn positioned in bearings 42 and 43. The entire assembly and driven portion 44 of the shaft 25 is connected directly to the source of rotational power which preferably is a hydraulic motor.

Figure 7:
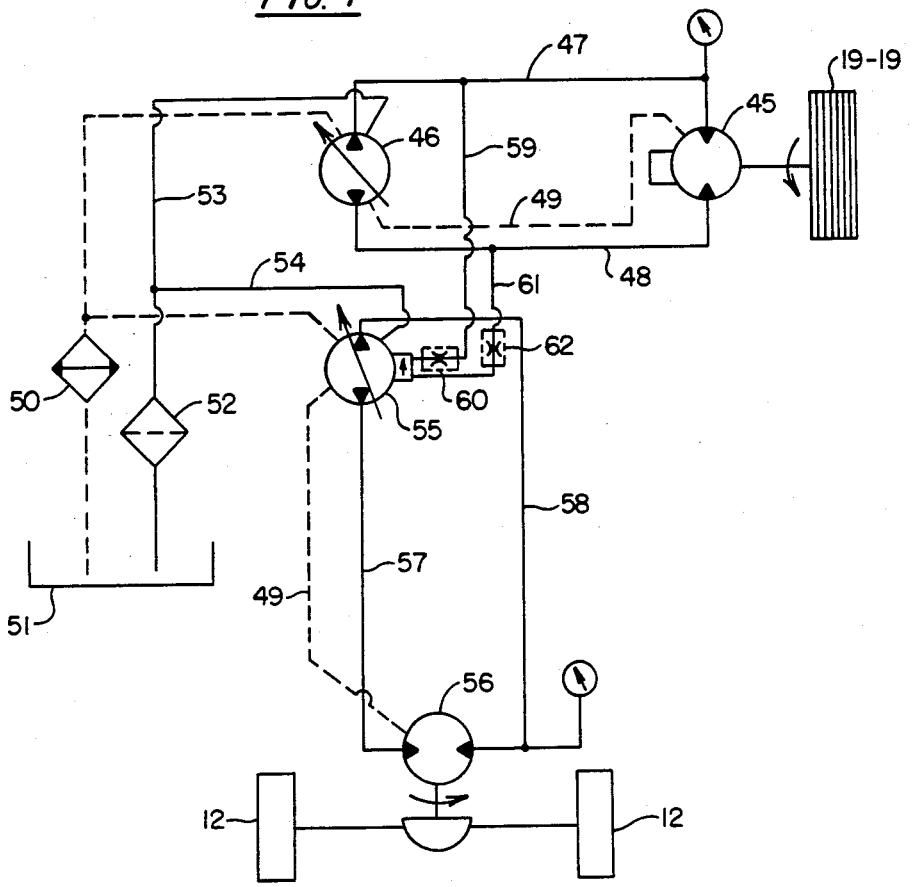
FIG. 7 is a schematic of the hydraulic control system used to control the propulsion of applicant's invention as well as the cutting speed of the pavement cutter.

Referring now to FIG. 7, the cuttings blades 19—19 may be directly connected to hydraulic motor 45 which in turn is driven by hydraulic pump 46 through pipe 47 or pipe 48, depending upon the direction of rotation desired for cutting blades 19—19. In order to maximize the life of the cutting blades 19—19, in addition to operating at an optimum surface speed, it is desirable to reverse the direction of rotation of the cutting blades 19—19 periodically so that during their life they are operated approximately one-half of the time in one direction and one-half of the time in the opposite direction.

Case drains 49—49 are shown which permit some of the hydraulic fluid to drain back through oil cooler 50 into the hydraulic reservoir 51. Makeup hydraulic fluid is drawn from reservoir 51 through suction filter 52 and by means of lines 53 and 54 is fed into pumps 46 and 55, respectively. Pump 55 is used to drive motor 56 which in turn is directly geared to the propelling wheels 12—12. Pump 55 is connected to motor 56 through lines 57 and 58, the line used being dependent upon the direction of rotation desired. The pumps 46 and 55 are variable displacement hydraulic pumps which are bi-directional. Hydraulic line 47 is connected through line 59 and orifice 60 to the control side of the swash plate of pump 55. Line 48 is likewise connected through line 61 and orifice 62 to the same control side of the swash plate of pump 55. Orifices 60 and 62 are incorporated to prevent surges in the feedback system.

In operation, the rotational speed of the cutting blades 19—19 is selected and manually adjusted by means of positioning of the swash plate in hydraulic pump 46 which in turn drives motor 45 at the desired speed. Once the cutting blades 19—19 are in cutting position in the pavement the device commences to move slowly, the motor 56 being controlled by the position of the swash plate in pump 55 which in turn is manually set by the operator. If the cutting blades 19—19 encounter denser pavement or reinforcing bars which would tend to slow their rotational speed and increase wear, higher pressure is produced by pump 46 in lines 47 or 48, depending upon the direction of rotation, which in turn is transmitted either through line 59 and orifice 60 or line 61 and orifice 62 to pump 55 causing pump 55 to reduce the amount of hydraulic fluid pumped by it through lines 57 or 58, again depending upon direction of travel, to motor 56 thus slowing the speed of rotation of propelling wheels 12—12 and thus the speed of the entire assembly thereby permitting the cutting blades 19—19 to maintain their optimal cutting speeds. Likewise, if the cutting blades 19—19 encounter less dense pavement being cut so that they would tend to rotate at a higher speed, the same sequence of events will cause the motor 56 to speed up thus propelling the vehicle forward at a higher speed so that the speed of rotation of the cutting blades 19—19 are maintained.

Thus it will be seen that applicant's invention permits slots of varying lengths and shapes to be cut in pavement, the cutting blades 19—19 always being at right angles to the tangent to that portion of the surface of the pavement where the slot is being cut and also permits the cutting blades 19—19 to be maintained at an optimal rotational speed, regardless of the density of the type of pavement encountered.

Figure 8:
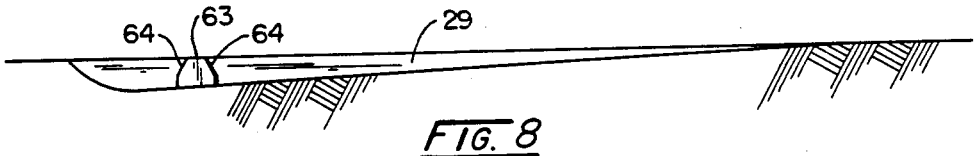
FIG. 8 is a side elevation sectional view showing a slot being cut for one-way traffic.

FIG. 8 shows a side sectional view of slot 29 cut in the pavement. The reflector 63 is positioned at the deep end of the slot. This is used for one-way traffic.

Figure 9:
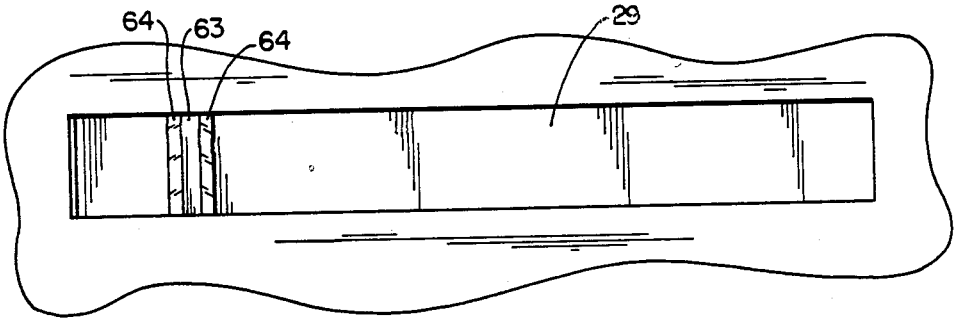
FIG. 9 is a plan view of the slot shown in FIG. 8.

FIG. 9 is a plan view of FIG. 8 showing the reflector 63 with its reflective portions 64—64 at an angle calculated to reflect headlights back to the driver of the oncoming car.

Figure 10:
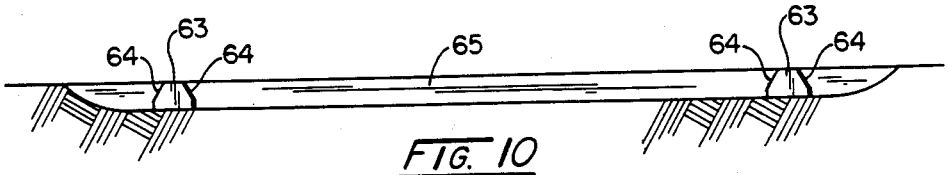
FIG. 10 is a side elevation sectional view of a slot which is cut for two-way traffic.

FIG. 10 shows a slot 65 which has been cut with a flat bottom with reflectors 63—63 being positioned at opposite ends thereof. This type of slot is used for two-directional traffic.

Figure 11:
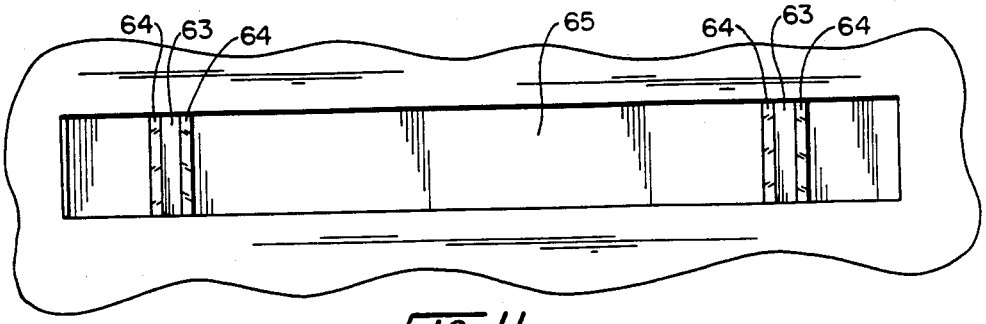
FIG. 11 is a plan view of the slot shown in FIG. 10.

FIG. 11 shows the same slot in plan view.

While this invention has been described in its preferred embodiment, it is to be appreciated that variations therefrom may be made without departing from the true scope and spirit of the invention.

What is claimed:

1. A device for cutting a slot in the surface of pavement, said slot being adapted to receive a headlight reflector, comprising support means positioned on said pavement, means associated with said support means for moving said support means from place to place, a rotary cutting means depending from said support means and of a width adapted to cut a slot in the surface of said pavement of a size adapted to receive a headlight reflector, means on said support means for providing power to operate said rotary cutting means, means on said support means for raising and lowering said rotary cutting means, said rotary cutting means being supported on an axis capable of being tilted, two cams adapted to rotate in engagement with said pavement as said support means is moved, said cams being spaced from each other and positioned on a common shaft and attached to said axis on which said rotary cutting means are supported so that said rotary cutting means performs its cutting function while at right angles to the tangent to that portion of the surface of pavement in which said slot is to be cut and so that the length and longitudinal shape of said slot is determined by said cams.

2. The device of claim 1 wherein said means for providing power to operate said cutting means is a first hydraulic motor and wherein said means for moving said support means from place to place is a second hydraulic motor.

3. The device of claim 1 wherein said cams are designed to cut a slot having a sloping bottom.

4. The device of claim 1 wherein said cams are designed to cut a slot having a flat bottom.

5. The device of claim 4 wherein said cams are adjustable to vary the length of the flat bottom of said slot.

6. The device of claim 2 comprising a first hydraulic pump supplying hydraulic fluid to said first hydraulic motor, a second hydraulic pump supplying hydraulic fluid to said second hydraulic motor, means connecting said first hydraulic motor and said second hydraulic pump responsive to the hydraulic pressure in said first hydraulic motor for varying the pressure in said second hydraulic pump and thus varying the speed of movement of said support means, depending upon the density of the pavement encountered by said rotary cutting means, thereby varying the speed at which said rotary cutting means is propelled, whereby the rotational speed of said rotary cutting means is maintained within prescribed limits so as to minimize wear on said rotary cutting means.

* * * * *